United States Patent [19]

Meier

[11] 4,164,244

[45] Aug. 14, 1979

[54] APPARATUS FOR DOSING BULK GOODS

[75] Inventor: Siegfried Meier, Neuhausen am Rheinfall, Switzerland

[73] Assignee: SIG Schweizerische Industrie-Gesellschaft, Neuhausen am Rheinfall, Switzerland

[21] Appl. No.: 839,745

[22] Filed: Oct. 5, 1977

[30] Foreign Application Priority Data

Oct. 5, 1976 [CH] Switzerland ..... 12580/76

[51] Int. Cl.[2] ..... B65B 3/08

[52] U.S. Cl. ..... 141/156; 141/256; 222/241; 222/333

[58] Field of Search ..... 141/255, 198, 129, 192–197, 141/250–254, 256–284, 140–143, 156–162; 222/52, 56, 59–63, 70, 241, 333; 198/674, 675

[56] References Cited

U.S. PATENT DOCUMENTS

| | | | |
|---|---|---|---|
| 2,014,617 | 9/1935 | Fischer | 141/255 |
| 3,148,802 | 9/1964 | Webb | 222/241 |
| 3,191,642 | 6/1965 | Saito | 222/241 |
| 3,305,133 | 2/1967 | Parker | 222/241 |

*Primary Examiner*—Houston S. Bell, Jr.
*Attorney, Agent, or Firm*—Spencer & Kaye

[57] ABSTRACT

An apparatus for cyclically dosing bulk goods for filling sequentially advanced receptacles has a dosing auger; an electric disc rotor motor connected to the auger to rotate the same and arranged to be electrically braked; a blocking device having an actuated state in which it prevents rotation of the auger and an idle state in which it permits rotation thereof; and a control device for setting the blocking device in the actuated state for blocking rotation of the auger after being brought at least approximately to a standstill by electric braking and thereafter maintaining the blocking device in the actuated state until the beginning of a successive dosing cycle.

4 Claims, 4 Drawing Figures

APPARATUS FOR DOSING BULK GOODS

BACKGROUND OF THE INVENTION

This invention relates to an apparatus for dosing bulk goods. The apparatus has a dosing auger which, in each operational cycle (dosing cycle), is driven to dispense the goods into sequentially advanced receptacles (bags or boxes) and is subsequently stopped. The auger is driven by an electromotor which is braked shortly before termination of the package filling cycle.

Swiss Pat. No. 277,718 discloses a dosing apparatus of the above-outlined type, utilizing electric braking for the drive motor. In practice, however, preponderantly mechanical braking mechanisms are used, since the electric braking arrangements were found to be undesirably slow. Accordingly, a conventional solution provides that between the motor and the auger shaft there is provided an electrically energizable and de-energizable clutch as well as an electrically operable mechanical brake. This solution, however, has the disadvantage that both the clutch and the brake are very noisy and have components exposed to wear. These disadvantages are magnified with increasing power of the dosing apparatus.

SUMMARY OF THE INVENTION

It is an object of the invention to provide an improved dosing apparatus of the above-outlined type which, although it may be of high power, ensures a component wear of reduced extent and a silent operation.

This object and others to become apparent as the specification progresses, are accomplished by the invention, according to which, briefly stated, the electromotor driving the auger is constituted by a disc rotor motor and there is further provided a blocking device which prevents rotation of the auger until the beginning of the successive dosing cycle after it has been brought at least approximately to a standstill by means of electric braking.

Electric disc rotor motors which have been manufactured for many years by various firms, such as Brown, Boveri and Cie. AG and Infranor, have a small amount of inertia of the rotor and may therefore be braked more rapidly than other conventional D.C. motors. As a result of extensive testing it has been unexpectedly found that a disc rotor motor, if associated with a shaft blocking device, may be used to operate even high-output dosing apparatuses which have no clutches or mechanical brakes.

DESCRIPTION OF THE PREFERRED EMBODIMENT

Figure 1:
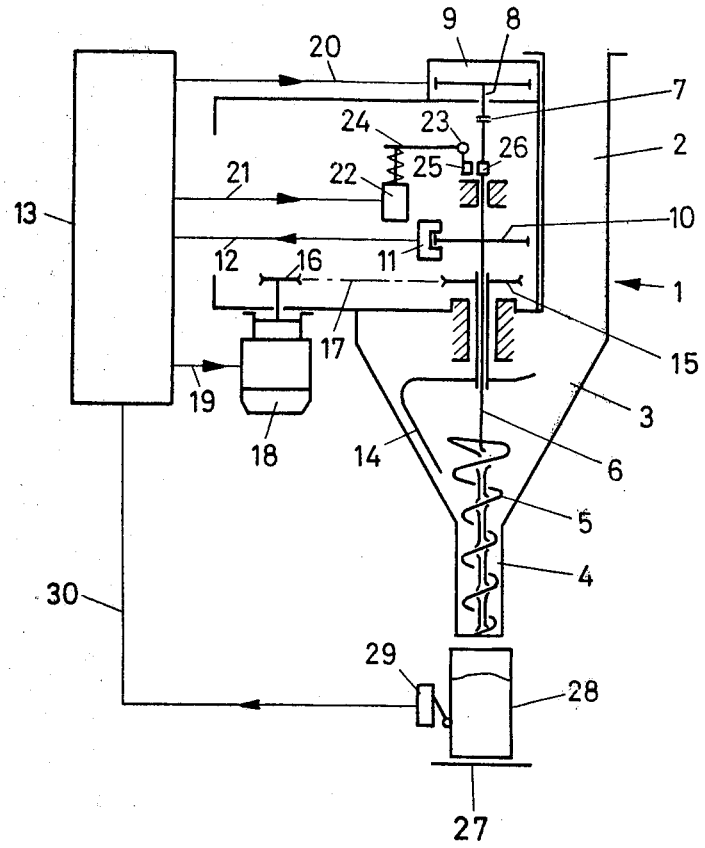
FIG. 1 is a schematic elevational view of a dosing apparatus incorporating a preferred embodiment of the invention.

Turning now to FIG. 1, there is schematically shown a dosing apparatus which has a housing 1 having an inlet hopper 2 for the bulk goods to be dosed. The hopper 2 leads to a feed funnel 3 which, in the downward direction, continues in an outlet pipe 4 which, in turn, accommodates the lower part of a dosing auger 5; the upper part thereof is situated in the zone of the feed funnel 3. The vertically disposed shaft 6 of the auger 5 is coupled, by means of a permanent coupling 7, with the axially aligned shaft 8 of a disc rotor motor 9 i.e. an Axem Motor type M23 of manufactured by Brown, Boveri and Cie AG.

With the shaft 6 there is associated a pulse generating device 10, 11 which emits electric signals as a function of the rotation of the shaft 6. The pulse generating device 10, 11 has a disc 10 which is mounted on the vertical shaft 6 of the auger 5 and which may be made of a magnetizable material and provided with peripheral teeth. The device 10, 11 further comprises a signal generator 11 which cooperates with the disc 10. Thus, each time a tooth of the disc 10 moves past the signal generator 11, the latter emits a pulse which is applied through a conductor 12 to an input of an electric control device 13. It is to be understood that the pulse-generating device 10, 11 need not be of the inductive type. A motor 18 which is connected with the control device 13 by a conductor 19, drives a stirring device 14 by means of a belt 17 trained about belt pulleys 15 and 16, affixed to the respective shafts of the stirring device 14 and the motor 18. The stirring device 14 is arranged coaxially with the shaft 6. An output of the control device 13 is connected by a conductor 20 with the disc rotor motor 9.

The shaft 6 is associated with a blocking device controlled by the control device 13. In particular, the blocking device comprises an electromagnet 22 connected with a further output of the control device 13 by a conductor 21. The armature of the electromagnet 22 serves for actuating a lever 24, pivotally supported at 23. The lever 24 carries a powerful permanent magnet 25 which is arranged adjacent an iron sleeve 26 secured to the shaft 6. When the electromagnet 22 is energized, its armature causes the lever 24 to pivot counterclockwise (as viewed in FIG. 1), whereupon the permanent magnet 25 engages the sleeve 26 and by friction blocks (immobilizes) the shaft 6 which, during this occurrence, has already been at least approximately brought to a standstill. In the blocking device 22–26 the components 25 and 26 may be replaced by a tooth and a gear, respectively, to thus constitute a ratchet wheel assembly where blockage is effected by engagement of the tooth (pawl) between the teeth of the gear (ratchet wheel). Further, the blocking device 22–26 may, in the alternative, be arranged in the disc rotor motor 9 to thus block the shaft 6 with the intermediary of the shaft 8 and the coupling 7.

Underneath the outlet pipe 4 there is arranged a table 27 on which the receptacles 28 (boxes or bags) to be filled are brought in succession into the filling position by means of a conveyor system, not shown. A sensor device 29 applies a signal (starting pulse) to an input of the control device 13 through a conductor 30 to indicate that a receptacle 28 has arrived in the filling position. The sensor device 29 may be of the electromechanical type as schematically shown; it will be understood that it may be of any other conventional structure (such as a photocell device).

Figures 2, 3:
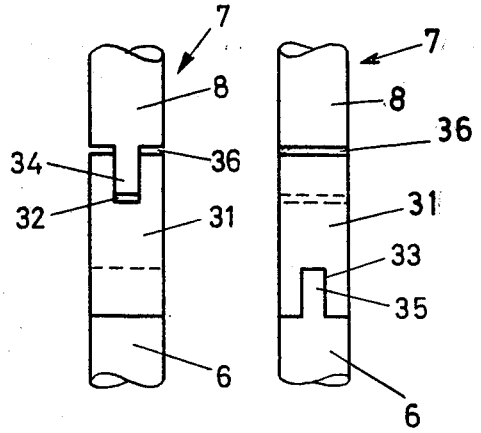
FIG. 2 is an elevational view of a permanent shaft coupling forming part of the same embodiment.
FIG. 3 is an elevational view of the structure shown in FIG. 2, taken in a direction perpendicular to that of FIG. 2.

The permanent coupling 7 may be, for example, a screw coupling. Preferably, however, the latter has, as shown in FIGS. 2 and 3, a coupling member 31 which is provided at the top and at the bottom with two grooves 32 and 33, respectively, arranged perpendicularly to one another. Into these grooves extend respective pins 34 and 35 which are provided, respectively, at the lower end of the shaft 8 and the upper end of the shaft 6. The coupling is thus torque transmitting but has an axial play 36 which facilitates assembly.

In the description which follows, the operation of the above-described dosing apparatus will be set forth.

As soon as the control device 13 receives a signal from the sensor device 29 indicating the presence of a receptacle 28 underneath the outlet pipe 4, it supplies, via the conductor 20, an energizing current to the disc rotor motor 9 which thus starts to rotate the auger 5 via the shafts 8 and 6. Assuming that the auger 5 has to execute six full revolutions in order to deliver the correct quantity of bulk goods and further assuming that the pulse-generating disc 10 has forty teeth distributed along its periphery, the control device 13 will, after having received 240 pulses ($6\times4=240$) via the conductor 12, actuate the blocking device 22–26 via the conductor 21 in order to block the shaft 6 until the filled package 28 is removed and is replaced by a new, empty receptacle. In the absence of the shaft blocking device 22–26, the continuously rotated stirring device 14 may impart an undesired rotary motion to the de-energized auger 5 with the intermediary of the bulk goods which act as a torque-transmitting medium in the feed funnel 3.

In order to ensure that the blocking device 22–26 operates in a jar-free manner, the shaft 6 should be at least approximately already at a standstill when the blocking device 22–26 is actuated. For this purpose, the control device 13 initiates the electric braking of the shaft 6 somewhat before the 240th pulse, for example, upon receipt of the 220th pulse. After the new, empty receptacle 28 has arrived in its filling position, the above-described operational cycle is repeated. It is to be understood that by the beginning of the successive operational cycle, the blocking device 22–26 has released the shaft 7 as a result of a timely de-energization of the electromagnet 22.

It is apparent that the number of pulses which trigger the operation of the electric brake of the motor and the shaft blocking device may be arbitrarily set in the control device 13. Thus, the dosing apparatus may be adapted in a very simple manner to the nature of the bulk goods and the volume of the receptacles.

Since the above-described dosing apparatus has no clutch or mechanical brake exposed to wear, the operation of the apparatus does not involve expenses for replacing worn components. Also, maintenance and adjustments need not be effected in this respect. Further, the reduction of the operational noise is very significant. Since the electrically braked motor 9 is a disc rotor motor in which the ratio of the nominal output to the moment of inertia of the rotor is significantly larger (as well known) than in other conventional motors where the rotor has an iron core, a very high dispensing output may be achieved, for example, more than one hundred filling operations per minute. The axially aligned arrangement of the motor 9 and the dosing auger 5 as well as their connection by means of an axially displaceable permanent coupling 31–35 is particularly expedient.

Figure 4:
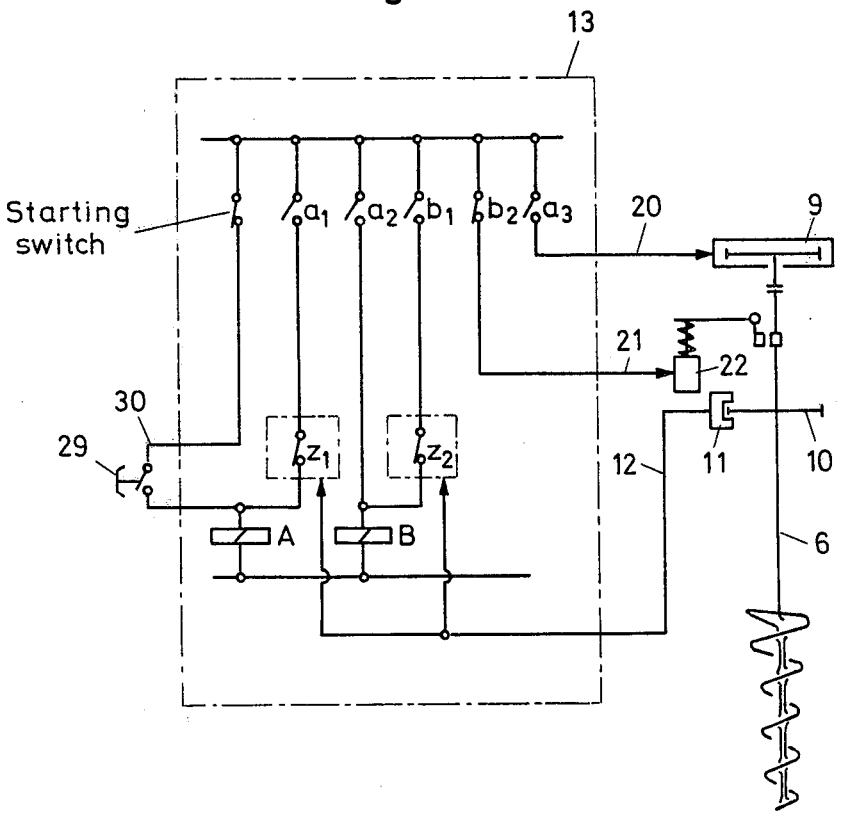
FIG. 4 is a schematic wiring diagram of the electrical control system.

The circuitry of the control deivce 13 is shown in detail in FIG. 4. The timing of the switches is such that there is just a receptacle 28 to be placed underneath the outlet pipe.

The control device 13 comprises two relays A and B each being equipped with several switches a1, a2, a3 and b1, b2 respectively. The coils of the relays are connected to two supply lines by means of presettable counter switches z1 and z2 and relay switches a1 and b1 respectively. Each of these lines is connected parallel to a further connection through a starting switch and a sensor switch 29 for relay A and a switch a2 for relay B.

By closing the starting switch (controlled, for example, by a clock pulse) and the sensor switch 29, relay A is energized and holds itself by the associated selfholding switch a1. Closing of switch a3 energizes the disc rotor motor 9 and by closing switch a2, relay B will be energized too. Relay B remains energized by the associated self holding circuit containing relay switch b1 and counter switch z2. When relay B is energized, switch b2 will open and deenergizes blocking device 22–26 for freeing shaft 6.

Pulses from the signal generator 11 are fed to counters z1 and z2 respectively. It is noted that the starting switch may be actuated by means of a carriage for receptacles, not shown.

When a preset number of pulses are fed to counters z1 and z2, e.g. 220 for counter z1 and 240 for counter z2, counter switch z1 opens and relay A drops, thereby switches $a_1$, $a_2$ and $a_3$ open and motor 9 is switched off and by shortcircuiting the rotor, shaft 6 is braked. Counter switch z2 opens thereafter the holding-circuit of relay B to open switch b1 and to close switch b2 for blocking shaft 6 by the blocking device 22–26.

It will be understood that the above description of the present invention is susceptible to various modifications, changes and adaptations and the same are intended to be comprehended within the meaning and range of equivalents of the appended claims.

What is claimed is:

1. In an apparatus for cyclically dosing bulk goods for filling receptacles in a filling position into which they are sequentially advanced, including a dosing auger; an electric motor connected to the auger to rotate the same; braking means for braking the electric motor shortly prior to the termination of a dosing cycle; the improvement wherein the electric motor is a disc rotor motor and said braking means is an electric braking means; further comprising a blocking device having an actuated state in which it prevents rotation of said auger and an idle state in which it permits rotation of said auger; control means for setting said blocking device in the actuated state after said auger has been brought at least approximately to a standstill by said electric braking means and maintaining said blocking device in the actuated state until the beginning of a successive dosing cycle; and a sensor means associated with the filling position and connected with an input of said control means for applying a signal thereto in response to sensing the arrival of a receptacle in the filling position; said control means including means for energizing said disc rotor motor for starting a dosing cycle in response to the receipt of said signal, means for energizing said electric braking means shortly before termination of the dosing cycle and means for setting said blocking device in said actuated state subsequent to the energization of said electric braking means.

2. An apparatus as defined in claim 1, further comprising a pulse-generating device operatively connected to said auger and a further input of said control means for applying to said control means a number of pulses proportionate to the rotational angle of said auger; said control means further including means for arbitrarily setting the number of pulses upon the receipt of which said means for energizing said electric braking means and said means for setting said blocking device are actuated by said control means.

3. An apparatus as defined in claim 1, further comprising a stirring device arranged in coaxial relationship with respect to said auger and an additional motor for continuously rotating said stirring device.

4. An apparatus as defined in claim 1, further comprising a drive shaft forming part of said disc rotor motor and an auger shaft forming part of said auger; and a permanent coupling torque-transmittingly connecting said shafts to one another; said permanent coupling including means providing for an axial play between said shafts.

* * * * *